US010828231B2

(12) United States Patent
Driscoll et al.

(10) Patent No.: US 10,828,231 B2
(45) Date of Patent: Nov. 10, 2020

(54) MULTI-MODE MASSAGE DEVICE USING BIOFEEDBACK

(71) Applicant: Dimensional Industries, Inc., San Diego, CA (US)

(72) Inventors: Jonathan Daniel Driscoll, San Diego, CA (US); Tamara Beth Harrison, Berkeley, CA (US)

(73) Assignee: DIMENSIONAL INDUSTRIES, INC., San Diego, CA (US)

( * ) Notice: Subject to any disclaimer, the term of this patent is extended or adjusted under 35 U.S.C. 154(b) by 913 days.

(21) Appl. No.: 14/553,880

(22) Filed: Nov. 25, 2014

(65) Prior Publication Data

US 2015/0119766 A1 Apr. 30, 2015

Related U.S. Application Data

(63) Continuation of application No. 14/065,377, filed on Oct. 28, 2013, now abandoned.

(51) Int. Cl.
*A61H 23/00* (2006.01)
*A61H 23/02* (2006.01)

(52) U.S. Cl.
CPC ..... *A61H 23/02* (2013.01); *A61H 23/00* (2013.01); *A61H 2201/018* (2013.01); *A61H 2201/501* (2013.01); *A61H 2201/5005* (2013.01); *A61H 2201/5035* (2013.01); *A61H 2201/5058* (2013.01); *A61H 2201/5061* (2013.01);

(Continued)

(58) Field of Classification Search
CPC .... A61H 23/00; A61H 23/02; A61H 23/0254; A61H 2230/00; A61H 2230/04; A61H 2230/045; A61H 2230/06; A61H 2230/065; A61H 2230/08; A61H 2230/085;

(Continued)

(56) References Cited

U.S. PATENT DOCUMENTS 4,596,256 A * 6/1986 Ascher ..... A61B 5/02438 600/523
5,782,745 A 7/1998 Benderev (Continued)

FOREIGN PATENT DOCUMENTS

| | | |
|---|---|---|
| WO | WO2007089638 | 8/2007 |
| WO | WO2013006264 | 1/2013 |
| WO | WO2013063505 | 5/2013 |

OTHER PUBLICATIONS

Je Joue: Program Yer Pleasure, Je Joue, Aug. 31, 2012.
OSIM uPixie gives you soothing massage relief at work, OSIM uPixie, Jan. 28, 2012.

*Primary Examiner* — Justine R Yu
*Assistant Examiner* — Christopher E Miller
(74) *Attorney, Agent, or Firm* — Perkins Coie LLP; Colin Fowler

(57) ABSTRACT

A multi-mode personal massaging including a sensor unit configured to detect one or more biofeedback signals from a user of a personal massaging device or a partner is disclosed. The system can further include a controller configured to analyze the one or more biofeedback signals, and determine one or more corresponding and modifiable outputs stored in a memory, based on the one or more biofeedback signals. The system can further include a massaging unit configured to output the one or more outputs determined by the controller, based on the one or more biofeedback signals.

19 Claims, 7 Drawing Sheets

(52) U.S. Cl.
CPC ..... *A61H 2201/5069* (2013.01); *A61H 2201/5084* (2013.01); *A61H 2201/5097* (2013.01); *A61H 2230/00* (2013.01); *A61H 2230/045* (2013.01); *A61H 2230/105* (2013.01); *A61H 2230/208* (2013.01); *A61H 2230/505* (2013.01); *A61H 2230/605* (2013.01); *A61H 2230/655* (2013.01)

(58) Field of Classification Search
CPC ..... A61H 2230/10; A61H 2230/105; A61H 2230/65; A61H 2230/655
See application file for complete search history.

(56) References Cited

U.S. PATENT DOCUMENTS 5,873,838 A * 2/1999 Mogi ..... A61B 5/0428 128/901
6,605,038 B1 8/2003 Teller et al.
6,749,577 B2 * 6/2004 Kume ..... A61H 15/0078 600/27
6,905,471 B2 6/2005 Leivseth
7,517,327 B1 4/2009 Knight
7,608,037 B2 10/2009 Levy
7,749,178 B2 7/2010 Imboden
7,762,945 B2 * 7/2010 Blumenthal ..... A61H 19/00 600/38
7,815,582 B2 10/2010 Imboden
7,938,789 B2 * 5/2011 Imboden ..... A61H 19/00 601/46
7,955,241 B2 6/2011 Hoffman
7,967,740 B2 6/2011 Mertens
8,255,299 B2 * 8/2012 Cambridge ..... A61H 19/32 705/35
8,308,667 B2 11/2012 Lee
8,500,627 B2 8/2013 Lee
8,721,523 B2 5/2014 Lee
8,747,337 B2 6/2014 Lee
9,011,316 B2 * 4/2015 Mertens ..... A61H 19/34 600/38
10,143,618 B2 * 12/2018 Cambridge ..... A61H 23/0254
2001/0044588 A1 * 11/2001 Mault ..... G16H 40/67 600/549
2003/0073881 A1 * 4/2003 Levy ..... A61H 19/44 600/38
2003/0158504 A1 * 8/2003 Hiyamizu ..... A61H 1/00 601/99
2003/0195441 A1 * 10/2003 Firouzgar ..... A61H 19/34 601/46
2003/0208113 A1 * 11/2003 Mault ..... A61B 5/14532 600/316
2006/0161071 A1 7/2006 Lynn et al.
2006/0270897 A1 * 11/2006 Homer ..... A61H 19/00 600/38
2007/0049792 A1 3/2007 Levy
2007/0179412 A1 8/2007 Imboden
2007/0179413 A1 8/2007 Imboden
2007/0179414 A1 8/2007 Imboden
2008/0065187 A1 3/2008 Squicciarini
2010/0045595 A1 * 2/2010 Bakke ..... A61H 19/00 345/156
2011/0098613 A1 4/2011 Thomas
2011/0245702 A1 * 10/2011 Clark ..... A61B 5/04284 600/523
2012/0136289 A1 5/2012 Mcgann
2013/0102937 A1 * 4/2013 Ehrenreich ..... A61H 1/00 601/47
2013/0109913 A1 5/2013 Imboden
2013/0110266 A1 5/2013 Snaterse
2013/0261385 A1 * 10/2013 Zipper ..... A61H 19/40 600/38
2013/0281868 A1 * 10/2013 Kawachi ..... A61B 5/02141 600/485
2013/0331745 A1 * 12/2013 Sedic ..... A61H 19/34 601/46
2014/0018713 A1 1/2014 Elenga
2014/0046127 A1 2/2014 Topolovac
2015/0119765 A1 4/2015 Driscoll
2015/0119766 A1 4/2015 Driscoll
2015/0119770 A1 4/2015 Driscoll
2015/0198455 A1 * 7/2015 Chen ..... G01C 21/3629 701/428
2015/0272817 A1 * 10/2015 Knyrim ..... A61H 19/34 601/46
2015/0328082 A1 * 11/2015 Jiang ..... A61H 19/00 600/38
2016/0000641 A1 1/2016 Driscoll
2016/0030279 A1 2/2016 Driscoll
2016/0073539 A1 3/2016 Driscoll
2016/0074276 A1 * 3/2016 Scheuring ..... A61H 9/0071 600/479

* cited by examiner

MULTI-MODE MASSAGE DEVICE USING BIOFEEDBACK

PRIORITY CLAIM

This application is a continuation of U.S. patent application Ser. No. 14/065,377, entitled "MULTI-MODE MASSAGE DEVICE USING BIOFEEDBACK" and filed on Oct. 28, 2013, the contents of which is expressly incorporated by reference herein.

FIELD

The present disclosure relates to a massaging apparatus configured to receive biofeedback used to output predefined, reprogrammable stimuli algorithms.

BACKGROUND

The therapeutic effect of vibratory or other stimulation on the human body has been well documented. Typically, personal massagers, such as handheld massagers, vibrating adult toys, and massage chairs, are designed to be completely autonomous, or to incorporate data from integrated sensors, such as pressure sensors or accelerometers. Moreover, conventional personal massagers are capable of storing pre-programmed routines selected by a user and downloadable via a USB connection, for example.

The prior art fails to disclose means to control such devices through sensors connected to a user, or another party, which allow for direct and/or automated control of the device using biofeedback of the user or the other party in real time.

SUMMARY

The presently disclosed embodiments are directed to solving one or more of the problems presented in the prior art, as well as providing additional features that will become readily apparent by reference to the following description when taken in conjunction with the accompanying drawings.

Methods and devices described herein are directed to a multi-mode personal massaging system including a sensor unit or multiple sensor units configured to detect one or more biofeedback signals from one or more bodies. The system can further include a controller configured to analyze the one or more biopotential signals, and determine one or more corresponding predefined outputs stored in a memory, based on the one or more biopotential signals. The system can further include a massaging unit configured to output the one or more outputs determined by the controller, based on the one or more biopotential signals.

Another embodiment is directed to method for personal massaging. The method can include detecting one or more biopotential signals from one or more bodies; analyzing the one or more biofeedback signals, and determining one or more corresponding outputs, based on the one or more biopotential signals; and outputting the one or more determined predefined outputs, based on the one or more biopotential signals.

According to various embodiments, the biopotential signals can include electrocardiogram (EKG/ECG) signals, electromyography (EMG) signals, electroencephalography (EEG) signals, and signals derived from this, such as event related potential signals (ERP). The control signal can include motion of the device itself, which could be interpreted by an algorithm as specific gestures linked to a certain output (for instance, rotation of the device could be used to increase the vibration intensity), or in other manners, just as outputs that detect and lock-in output patterns to the user motions.

According to various embodiments, a user of a massaging device can experience varying, and modifiable, stimulation dependent upon biofeedback signals obtained from the user or a partner.

Further features and advantages of the present disclosure, as well as the structure and operation of various embodiments of the present disclosure, are described in further detail below.

BRIEF DESCRIPTION OF THE DRAWINGS

The present disclosure, in accordance with one or more various embodiments, is described in details with reference to the following figures. The drawings are provided for purposes of illustration only and merely depict one exemplary embodiment of the disclosure. These drawings are provided to facilitate the reader's understanding of the disclosure and should not be considered limiting the breadth, scope, or applicability of the disclosure. It should be noted that for clarity and ease of illustration these drawings are not necessarily made to scale.

DETAILED DESCRIPTION OF EXEMPLARY EMBODIMENTS

The following description is presented to enable a person of ordinary skill in the art to make and use the invention. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the disclosure. Thus, the present disclosure is not intended to be limited to the examples described herein and shown, but is to be accorded the scope consistent with the claims.

The word "exemplary" is used herein to mean "serving as an example or illustration." Any aspect or design described herein as "exemplary" is not necessarily to be construed as preferred or advantageous over other aspects or designs.

Moreover, it should be understood that the specific order or hierarchy of functional steps in the processes disclosed herein is an example of exemplary approaches. Based upon design preferences, it is understood that the specific order or hierarchy of steps in the processes may be rearranged while remaining within the scope of the present disclosure.

Embodiments described herein include a multi-mode personal massaging system in which a user of a massaging device can experience various pre-defined output stimuli dependent upon biofeedback (also referred to as "biopotential," when appropriate) signals obtained by one or more sensors communicatively coupled to the user or another party. The biofeedback signals can be used to determine one or more outputs stored in a memory, such that the massaging device is configured to produce any corresponding output varying with the sensed biofeedback signals automatically in real time.

Figure 1:
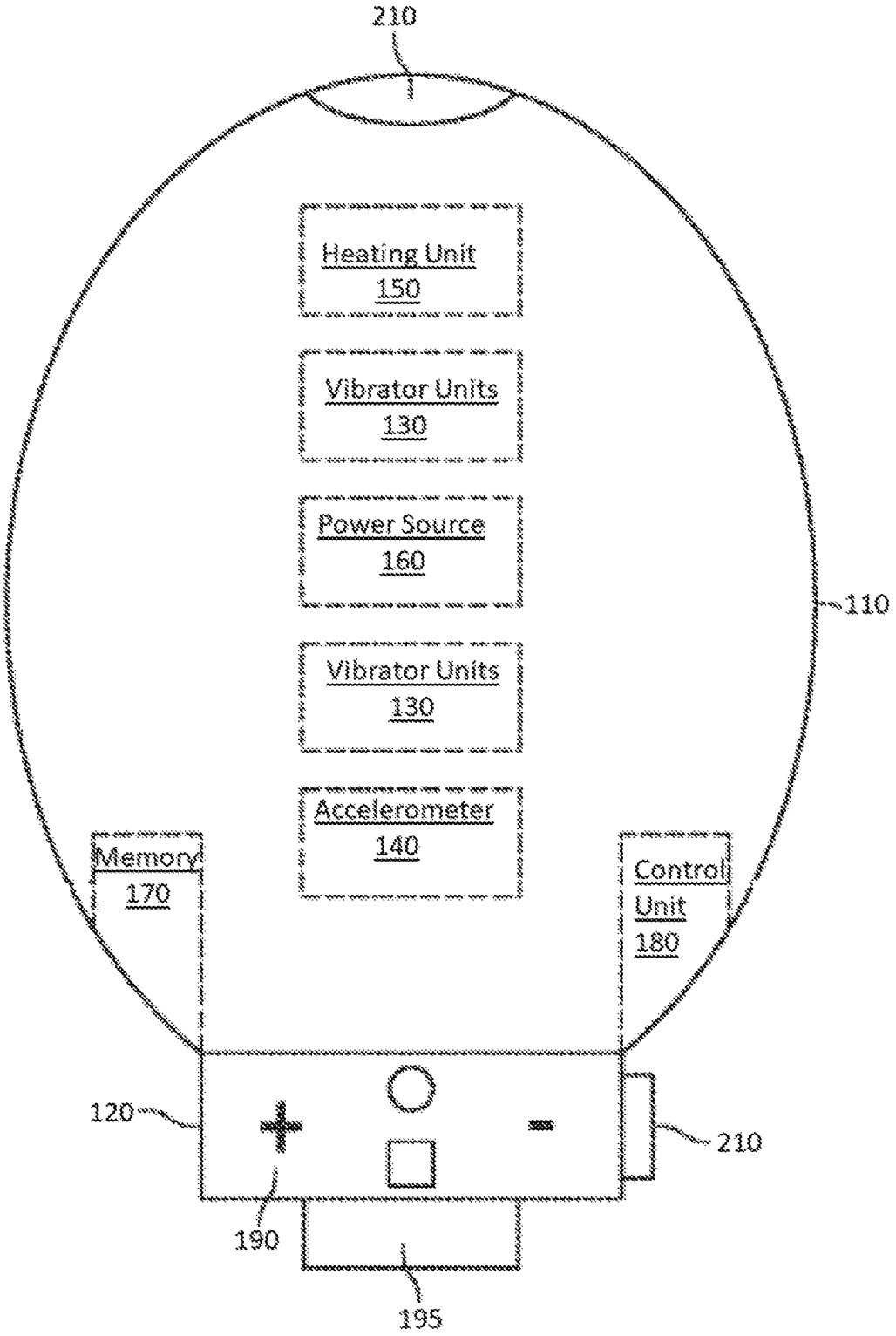
FIG. 1 is an exemplary personal massaging device, according to an embodiment of the present disclosure

FIG. 1 illustrates an exemplary personal massaging device, according to an embodiment of the present disclosure. As shown in FIG. 1, the personal massaging device 100 (also called "personal massager") includes a main body 110 that can house electronics and power source(s) 160 required to operate the device. Main body 110 can include one or more vibrator units 130, such as vibration motors, configured to cause the device 100 to vibrate, along with one or more accelerometers 140 (which could be any combination of accelerometer, gyroscope, and/or compass for sensing positioning and movement of the device 100) to detect angular positioning of the device 100. Main body 110 can further include a heating unit 150 configured to heat the personal massaging device 100.

Personal massaging device 100 can include a handle 120 for the user to hold. Handle 120 can house one or more buttons 190, or other similar control elements, which allow the user to adjust various characteristics of the output of the personal massaging device 100, such as vibration intensity, temperature, or which on-board algorithm is in control of the input-output relationship, etc. The locations of the various components, the handle 120 and main body 110 are depicted in FIG. 1 as merely one example, and various configurations, as well as combinations of hardware, may be employed.

Figure 3:
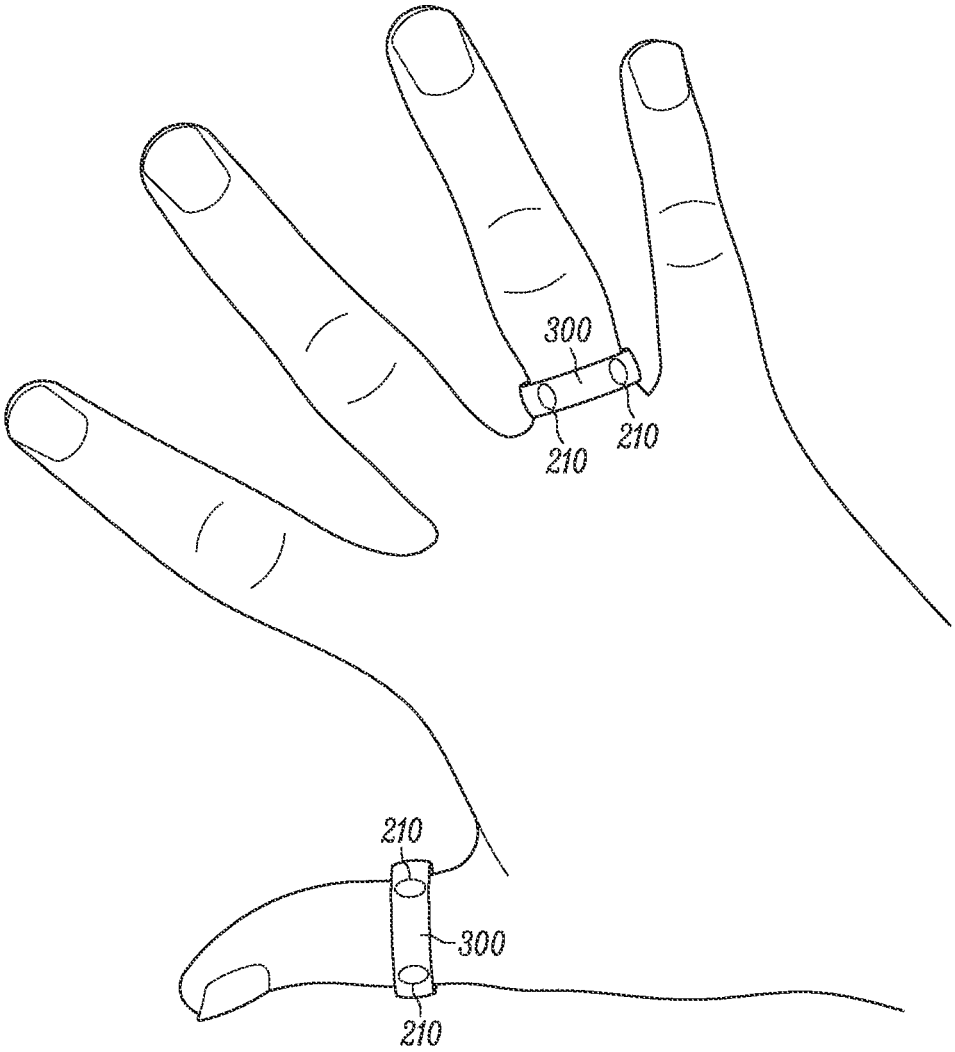
FIG. 3 is an exemplary sensor unit formed into a ring, according to an embodiment of the present disclosure.

Main body 110 can further include a memory storage unit 170 configured to store predefined modes, or outputs, which can cause the vibrator unit(s) 130, lighting unit(s), heating unit(s) 150 and/or audio unit(s) to activate dependent upon various inputs provided by sensor units 210 (see FIG. 3). As described herein, according to an embodiment, biofeedback signal obtained by sensor units can be used to determine which of the one or more various modes, or outputs, the personal massaging device 100 can produce.

Main body 110 can also have a transceiver unit 195 configured to receive wireless signals transmitted by sensor units via Bluetooth, cellular connectivity, WiFi connectivity or any other similar wireless communication technique. Of course, one of ordinary skill in the art would realize that any conventional hard-wired connectivity can similarly be utilized, without departing from the scope of the present disclosure.

A control unit 180 may be employed within main body 100. The control unit may be a programmable processor configured to control the operation of the personal massaging device 100 and its components. For example, the control unit 180 may be a microcontroller ("MCU"), a general purpose hardware processor, a digital signal processor ("DSP"), an application specific integrated circuit ("ASIC"), field programmable gate array ("FPGA") or other programmable logic device, discrete gate or transistor logic, discrete hardware components, or any combination thereof designed to perform the functions described herein. A general-purpose processor can be a microprocessor, but in the alternative, the processor can be any processor, controller, or microcontroller. A processor can also be implemented as a combination of computing devices, for example, a combination of a DSP and a microprocessor, a plurality of microprocessors, one or more microprocessors in conjunction with a DSP core, or any other such configuration.

Figure 2:
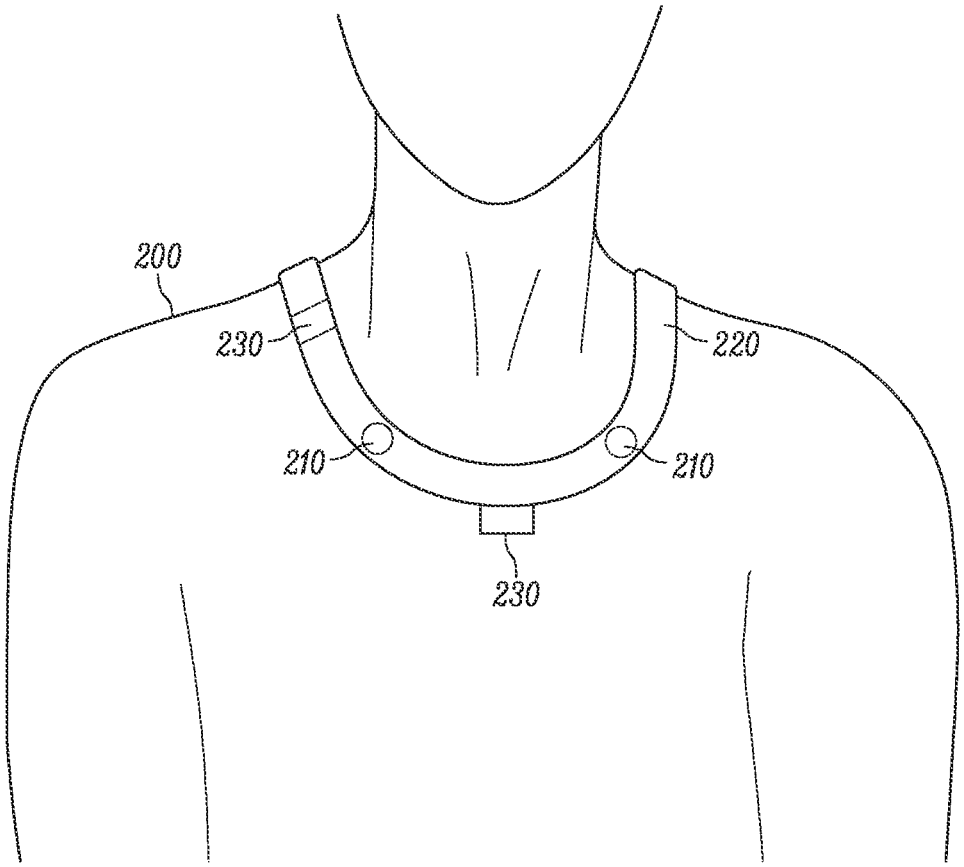
FIG. 2 is a user with exemplary sensor units communicatively coupled to a personal massaging device, according to an embodiment of the present disclosure.

FIG. 2 is an exemplary diagram of a body 200 with sensor units 210 attached thereto. It should be noted that body 200 could be the user of the personal massaging device 100, or could be another party who is not in physical contact with personal massaging device 100. In this exemplary embodiment, sensor units 210 are electrocardiogram (EKG or ECG) electrodes placed in the region of the heart of body 200. Sensor units 210 could similarly be capacitive sensors or any other conventional sensor used to obtain EKG signals. The voltage signal generated by the heart can be easily measured, typically on the millivolt level, using appropriately positioned sensor units 210. Frequently, dual sensors can be used, which process the signal differentially, thus dramatically reducing noise and pickup from EMI or capacitively coupled sources, such as power lines.

In this example, the sensor units 210 are incorporated as part of a necklace 220, which functions to keep the sensor units 210 in the correct position to read the signals, but can also provide an aesthetically pleasing mechanism for sensing biofeedback signals.

Necklace 220 can further include a transmitter 230 capable of wirelessly communicating with personal massaging device 100, via cellular communication, WiFi, Bluetooth, or any other wireless communication technique. Transmitter 230 could be located anywhere on the necklace 220, or could be incorporated as a pendant, or the like. The biofeedback signals sensed by sensor units 210 can be transmitted via transmitter 230 in real time. Transmitter 230 can either transmit raw data information, such as a voltage trace of the biopotential signal (such as EEG or EKG), or a processed form of the data (such as whether alpha or gamma waves are dominant in the case of EEG, showing various mental states, or the heartrate in the case of EKG). In this case, a processor unit may be housed communicatively coupled to the sensor units 210 and transmitter 230, and may be configured to process the data as necessary. In addition, transmitter 230 could send information that is semi-processed, such as filtered EKG or EEG information. As discussed in further detail below, necklace 220 could be worn by the user of the personal massaging device 100, or a partner.

Since the processor on the vibration unit can be reprogrammed, any number of possible input/output relationships are possible. For instance, the massager could pulse in time to the heartbeat, or harmonicas or subharmonics or the heartrate. Or, for instance, the intensity could vary based on heartrate, for instance slowing down if an elevated heartrate indicates too much vibration.

Similarly, the frequency content of EEG signals can be analyzed to indicate if alpha (typically indicating relaxation), beta (indicating alertness), theta (indicating meditation/light sleep), or gamma waves, etc, are dominant, indicating the mental state of the user. These can be used to map directly to outputs, such as more intense vibrations during alertness or meditation.

The biosensor output can be used to direct the output of the vibration, for example, in an algorithmic sense. For instance, the vibrations could vary through a large number of different patterns/intensities, using biofeedback to get a sense of how the user is responding (for instance, higher pulse rate could indicate enjoyment). This type of interaction could be used to generate a "stimulation mapping" of what is or is not enjoyable for the user, and the vibration patterns could be changed, via an algorithm, to center on patterns that are most enjoyable to the user.

Upon reception at the personal massaging device 100, the signal(s) transmitted by transmitter 230 corresponding to a sensed biofeedback signal (e.g., a heartbeat, according to the present embodiment), the processor can analyze the received signal and assign a corresponding pre-programmed output stored in the memory unit of personal massaging device 100. According to one example, the pre-programmed output may be to pulse the vibrator motor(s) within massaging device 100 at a rhythm consistent with the sensed heartbeat. As an alternative, the intensity of the vibrator motor(s) that the user of personal massaging device 100 experiences can increase or decrease as the sensed beats per minute rises or falls. As mentioned above, vibration is not the only possible output; the personal massaging device 100 can also be pre-programmed to increase its temperature, illuminate a light source (e.g., LED lighting) or produce audible sound consistent with the real-time biofeedback signals sensed by sensor units 210. One of ordinary skill in the art would realize that this can be further expanded to include the use of lights or dual vibrator motors, which can be phased to respond to different aspects of the EKG trace. For instance, each heartbeat could result in a "back to front" activation pattern of the motors. However, this is by no means a complete description of the ways in which the input/output relationship can be formed; various other interactions can be output, such as incorporating the heart rate signal with pressure, accelerometer detections, button press data entered by a user, and/or the amount of time the program has been running (for instance, taking several minutes to "warm up").

The reprogrammable outputs can be stored in the memory of personal massaging device 100 during production, or a user can select which outputs to assign to which sensed biofeedback signals. Thus, the output stimuli can be modifiable and/or reprogrammable by a user. The user could select different types of input/output relationships (such as pre-programmed "games" or "apps) using buttons on the handle 120, or other inputs to the system, such as the accelerometer 140. For example, "apps" could be selected, based on how the device is pointing when started up, or when the button is pressed. There could also be fixed apps, so only one starts up; an app to go only through the network connection. One of ordinary skill in the art would understand that the apps can be changed/loaded via any wireless network, or other communication mechanism.

Figure 4:
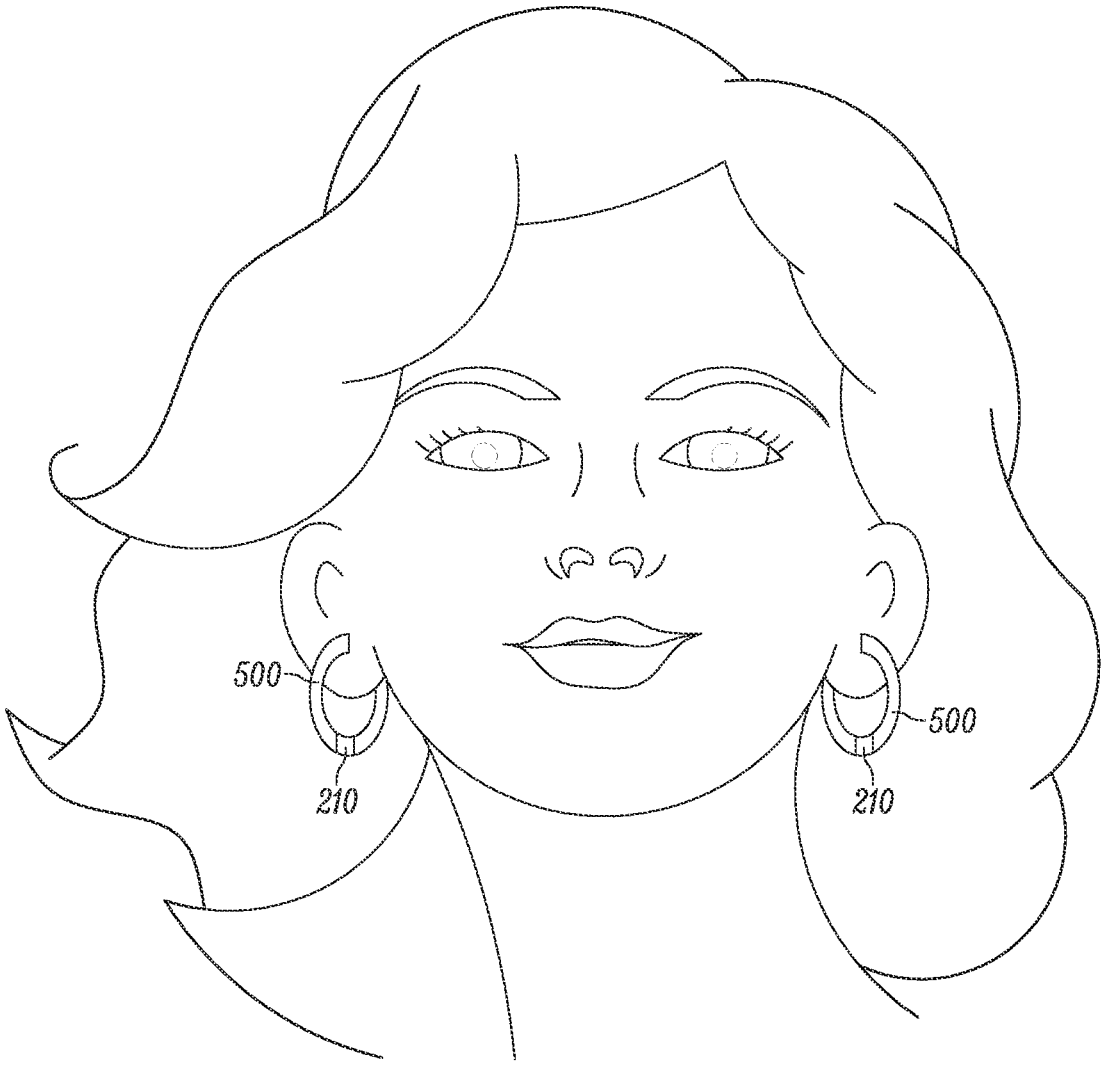
FIG. 4 is an exemplary sensor unit formed into earrings, according to an embodiment of the present disclosure.
Figure 5:
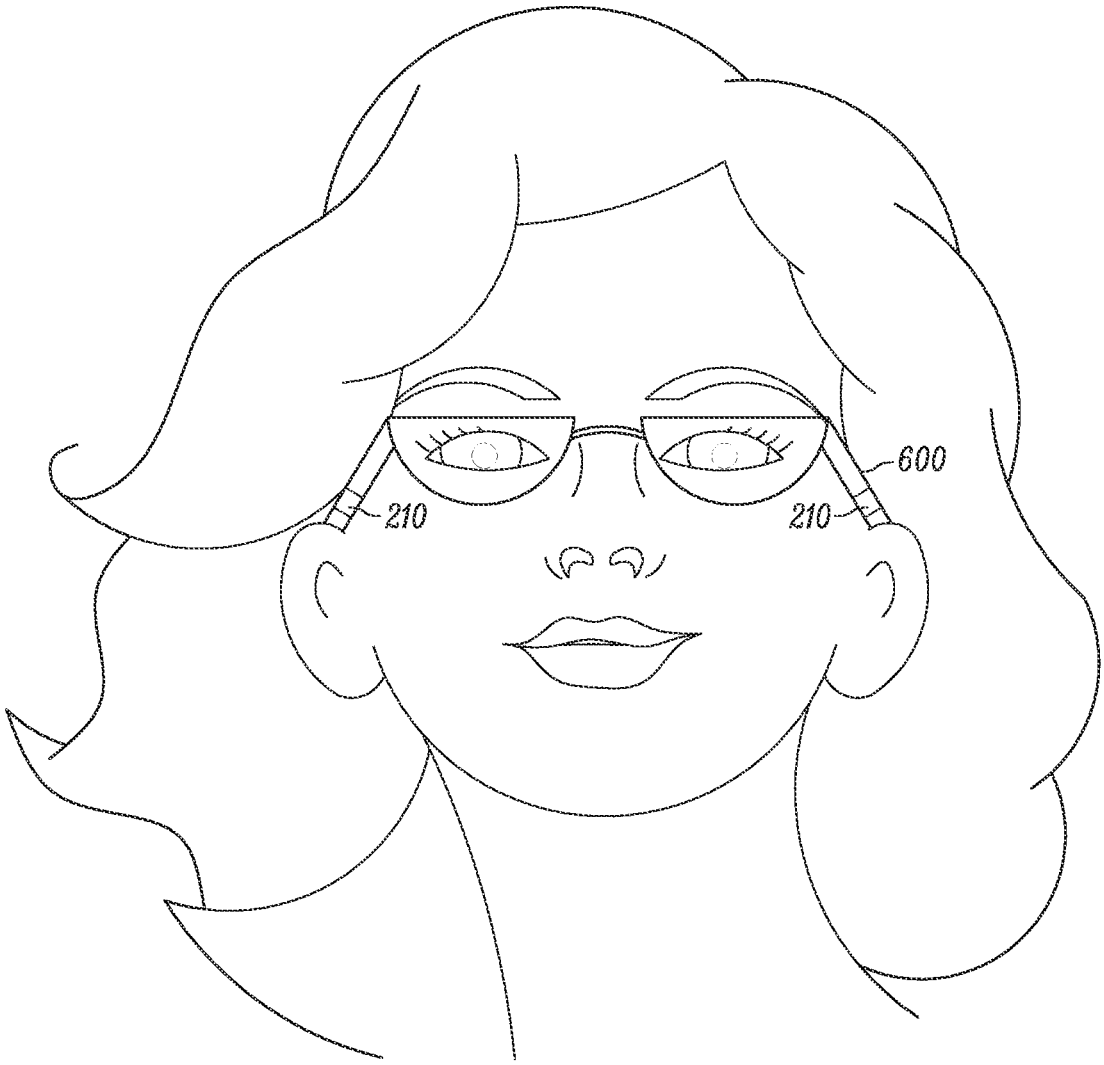
FIG. 5 is an exemplary sensor unit formed into spectacles, according to an embodiment of the present disclosure.

In the exemplary embodiment depicted in FIG. 2, the sensor units 210 are incorporated as part of necklace 220; however, other similar wearable items can be employed to communicatively connect sensor units 210 to a body. For example, sensor units 210 could be incorporated into a ring 300 (FIG. 3), earrings 500 (FIG. 4), spectacles 600 (FIG. 5), etc., positioned on body 200 in order to sense a biofeedback signal, such as a heartbeat, or other forms which bring sensor units 210 into contact with the body, such as sensors embedded in clothing, for example. In the depicted embodiments, various numbers of sensor units 210 are placed at various locations. It should be understood that any number of sensor units 210 may be placed at different locations on the respected apparatus in order to sense biopotential signals, without departing from the scope of the present disclosure.

In the examples above where sensor units 210 are incorporated with an aesthetic design (e.g., as part of necklace 220 or ring 300), The electronic components for the biosensor unit 210, microcontroller, and transmitter could be built into the apparatus using the bare die, rather than the typically epoxy overmolded chips. Using the bare die decreases size and weight, and also gives an attractive, jewelry like look to the device, because the iridescent die could be covered with a clear enclosure or potting material.

It should be further noted that sensing only the heartbeat is by no means necessary—the output could be dependent on harmonics or sub-harmonics of the heart rate, thus increasing the dynamic range of the output. Similarly, measurements such as overall activity, or any change in activity (e.g., quickly speeding up or slowing down) can be used to determine a corresponding output.

Although EKG signals are described above, one of ordinary skill in the art would realize that electromyography (EMG) or electroencephalography (EEG) signals could be detected using conventional sensor units 210. In the case of detecting EMG signals, electrical potentials from muscles are measured directly. In the case of detecting EEG signals, electrical activity from the brain can result in a measurable potential on the surface of the skin, which can be measured non-invasively. Similarly to the EKG case described above, the output can either be locked to brain waves, or probably more typically, subharmonics of the brain waves, since they are relatively high frequency. A transition between different states of alertness and arousal, typically exhibited by a shift in underlying frequency of the EEG activity could be used to determine an appropriate output. Moreover, other methods of processing could be used, such as detection of dreaming, etc. Again, differential measurement, while not strictly required, can be utilized to greatly reduce interference.

Similarly, an event-related potential (ERP) response to a vibratory stimulus can be measured and classified using techniques that have been established in the field. The resultant ERP/stimuli information can be used to direct and influence the input/output relationship of the device. For instance, certain characteristic ERPs may indicate changes in user attention and/or alertness correlated in time with a stimulus, and could correspondingly be used to modify the presentation of that or additional stimuli. Or, for instance, certain characteristic ERPs may indicate user displeasure or interest with in stimulus, and could correspondingly be used to decrease or increase the frequency of presentation of those stimuli.

Other types of sensor units 210 can include microphone(s) configured to receive sound vibrations, which can be processed and analyzed to determine various outputs from the massaging device 100. A "voice coil" type of vibration device can be employed, which is constructed similarly to an audio speaker with a weight attached to cause shaking in the massaging device 100, as one exemplary output.

Appropriate sensor units 210 can be utilized to obtain galvanic skin response, blood oxygen levels, temperature, and/or respiration. Each biofeedback signal can be similarly used as a basis for an output by massaging device 100. Various combinations of biofeedback signals can be a basis for various algorithmic outputs in order to produce stimuli for a unique and modifiable user experience.

Figure 6:
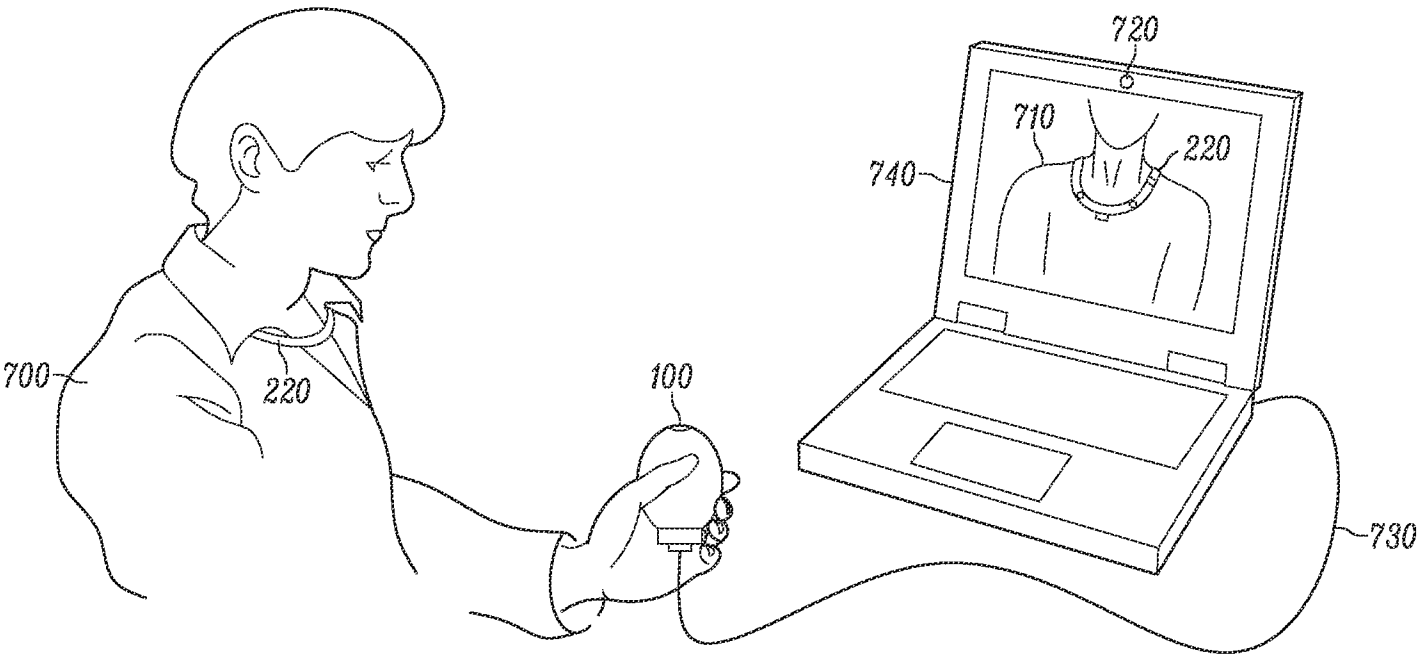
FIG. 6 is an exemplary multi-mode personal massaging system where biofeedback is obtained from a remote partner, according to an embodiment of the present disclosure.
Figure 7:
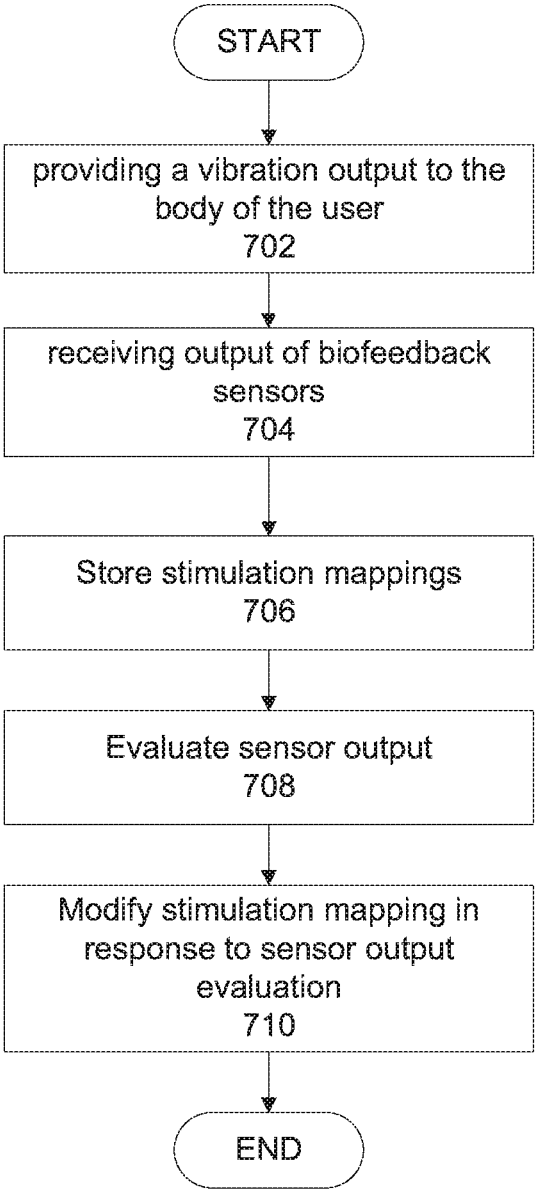
FIG. 7 is a flowchart illustrating a method of operation of a vibration device.

As noted above, the biofeedback signal can originate from either the person using the personal massaging device 100 (for instance, allowing the device to speed up/increase intensity with alertness or arousal of the user), or can be detected from another person, for an intimate interpersonal experience. In the case where the device is being connected to the biopotentials of the user of the personal massaging device 100, the connection can be wired, or wireless. In the case where the biofeedback is from a partner, the connection can be wired, wireless, or through a network connection (i.e., the partner can be located a distance away). As shown in FIG. 6, a user 700 of the personal massaging device 100 can interact with a partner 710 via a webcam and microphone 720, for example, at any distance, via the Internet. In this case, the partner 710 and/or the user 700 are in physical contact with sensor units 210 (included on a necklace 220, according to this example), and can maintain a visual with the user 700 of the personal massaging device 100. Biofeedback signals from the partner sensed by sensor units 210 can be transmitted via a network connection or cellular connectivity, for example, directly to personal massaging device 100 or another processor communicatively coupled to personal massaging device 100 (e.g., the user's computer 740 communicatively coupled to personal massaging device 100 via wireless connection or hard wired 730 connected to a USB port, for example). The sensed signals by sensor units 210 can be transmitted to the network via a wired or wireless connection. Processor unit 180 of the personal massaging unit 100 can interpret the signal(s) in real time and assign a corresponding output from memory unit 170, dependent on the biofeedback of the partner remotely located. The exemplary embodiment of FIG. 6 depicts partner 710 at a remote location observing user 700 via a webcam, but one of ordinary skill in the art would understand that both the user 700 and partner 710 could be in close proximity, such as in the same room. It also to be understood that the communication device could be a personal computer, a cellular telephone, tablet computing device, or any other device which allows for a connection to a wireless or wired sensor and network.

Although certain embodiments above describe sensor units 210 located on various objects (e.g., necklace 220), it should be understood that sensor units 210 could be placed at either end of personal massager 100 itself, in order to sense biopotential signals from the user of the massager 100, in real time as the user is experiencing stimuli from the massager 100 (see FIG. 1). In this example, the biopotential can be sensed between the hand of the user holding handle 120 and a body part in contact with another part of the massager 100.

As a result of the foregoing methods and systems a user of a massaging device 100 can experience varying stimulation dependent upon biofeedback signals obtained by sensors units 210 communicatively coupled to the user or even a partner. The biofeedback signals can be used to determine one or more predefined outputs stored in a memory, such that the massaging device 100 can automatically produce any corresponding output varying with the sensed biofeedback signals in real time.

While various embodiments of the invention have been described above, it should be understood that they have been presented by way of example only, and not by way of limitation. Likewise, the various diagrams may depict an example architectural or other configuration for the disclosure, which is done to aid in understanding the features and functionality that can be included in the disclosure. The disclosure is not restricted to the illustrated example architectures or configurations, but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to", or other like phrases in some instances shall not be read to mean that the narrower case is intended or required in instances where such broadening phrases may be absent.

Furthermore, although individually listed, a plurality of means, elements or method steps may be implemented by, for example, a single unit or processing logic element. Additionally, although individual features may be included in different claims, these may possibly be advantageously combined. The inclusion in different claims does not imply that a combination of features is not feasible and/or advantageous. Also, the inclusion of a feature in one category of claims does not imply a limitation to this category, but rather the feature may be equally applicable to other claim categories, as appropriate.

What is claimed is:

1. A vibration device for delivering stimulation by providing one or more modifiable outputs to a user upon contact of the vibration device with a body of the user, comprising:

a vibrator unit configured to provide a vibration output for delivering the stimulation;

a wireless transceiver configured to communicate with a plurality of biofeedback sensors, the plurality of biofeedback sensors including at least two biofeedback sensors of a matching type that generate differential readings, wherein at least one of the two biofeedback sensors is incorporated into a necklace;

a memory unit configured to store stimulation mappings, wherein the stimulation mappings define an association between an output of the plurality of biofeedback sensors and an output pattern of the vibration device, wherein at least one of the stimulation mappings is reprogrammable; and a controller configured to evaluate the output of the plurality biofeedback sensors differentially based on a specified criterion in response to performance of a first stimulation mapping, and to modify the output pattern of a second stimulation mapping based on the output pattern of the first stimulation mapping, wherein the modification of the second stimulation mapping is responsive to the evaluation of the output of the plurality of biofeedback sensors of the first stimulation mapping according to the specified criterion.

2. The vibration device of claim 1, wherein the output pattern of the vibration device comprises any of:

a vibration intensity that corresponds to the motion;

a pulsing rhythm that corresponds to the motion; or a vibration pattern that corresponds to the motion.

3. The vibration device of claim 1, further comprising:

a set of control elements configured to receive inputs from the user to adjust the vibration output.

4. The vibration device of claim 3, wherein the vibration output is responsively modified based on the inputs received from the user.

5. The vibration device of claim 3, wherein the at least one of the stimulation mappings is reprogrammed based on the inputs received from the user.

6. The vibration device of claim 1, further comprising: an accelerometer unit wherein the output pattern of the vibrator device further includes an angular positioning of the vibration device via the accelerometer unit.

7. The vibration device of claim 1, further comprising: a heating unit wherein the output pattern of the vibrator device further includes a heating output via the heating unit; and an audio unit wherein the output pattern of the vibrator device further includes an audio output via the audio unit.

8. The vibration device of claim 7:

wherein the vibration device is further configured to identify the output of the plurality of biofeedback sensors associated with the heating output and the audio output;

wherein the controller is further configured to evaluate the output of the plurality of biofeedback sensors associated with the heating output and the audio output of the first stimulation mapping based on the specified criterion to identify a second output pattern, and to modify the output pattern of the second stimulation mapping based on the second output pattern identified.

9. The vibration device of claim 8, wherein the second output pattern comprises any of:

a temperature change that corresponds to the biofeedback signals; or an audible sound that corresponds to the biofeedback signals.

10. The vibration device of claim 1, further comprising:

a local sensor unit configured to locally detect biofeedback signals from the body of the user receiving the vibration output.

11. The vibration device of claim 10, wherein at least one of the plurality of biofeedback sensors are incorporated into any of, a ring, an earring, spectacles, or clothing.

12. The vibration device of claim 1, wherein the necklace is positioned on a separate device from the vibrator unit and configured to be worn by a secondary user.

13. The vibration device of claim 1, wherein the output of the plurality of biofeedback sensors includes an electrocardiogram (EKG) signal indicative of a heartbeat.

14. The vibration device of claim 13, wherein the stimulation mapping comprises any of:

a vibration intensity that corresponds to the heartbeat;

a pulsing rhythm that corresponds to the heartbeat; or a vibration pattern that corresponds to the heartbeat.

15. A method for delivering stimulation by providing one or more modifiable outputs via a vibration device to a body of the user, comprising:

providing a vibration output to the body of a user according to a first stimulation mapping;

receiving output of a plurality of biofeedback sensors, the plurality of biofeedback sensors including at least two biofeedback sensors of a matching type that generate differential readings, wherein at least one of the two biofeedback sensors is incorporated into a necklace;

storing stimulation mappings, including the first stimulation mapping, in a memory unit, wherein the stimulation mappings define an association between an output of the plurality of biofeedback sensors and an output pattern of the vibration device, wherein at least one of the stimulation mappings is reprogrammable;

evaluating, by a controller, the output of the plurality of biofeedback sensors differentially in response to the first stimulation mapping based on a specified criterion; and in response to said evaluating, modifying, by the controller, the output pattern of a second stimulation mapping based on the output pattern of the first stimulation mapping.

16. The method of claim 15, wherein the output pattern comprises a back-to-front activation of a motor providing the vibration output, the back-to-front activation corresponding to the motion of the vibration device.

17. The method of claim 15, wherein said receiving output of the plurality of biofeedback sensors further comprises:

receiving the output from a first user wearing at least one biofeedback sensor of the plurality of biofeedback sensors in response to application of the output pattern of the vibration device to a second user.

18. The method of claim 15, further comprising:

detecting dual electrocardiogram (EKG) signals from the body of the user receiving the vibration output, the one or more EKG signals indicative of a heartbeat of the user; and transmitting the dual EKG signals to a processor configured to perform the evaluating, using a wireless communication mechanism.

19. The method of claim 18, wherein the stimulation mappings comprise any of:

a vibration intensity that corresponds to the heartbeat of the user;

a pulsing rhythm that corresponds to the heartbeat of the user; or a vibration pattern corresponding to the heartbeat of the user.

* * * * *